United States Patent [19]

Petropoulos et al.

[11] 4,083,175

[45] Apr. 11, 1978

[54] SOLID STATE WATCH WITH SINGLE TIME AND DATE SELECTOR BUTTON

[75] Inventors: Nick Petropoulos, Mission Viejo; William G. Holt, Irvine, both of Calif.

[73] Assignee: Frontier Manufacturing, Inc., Newport Beach, Calif.

[21] Appl. No.: 577,201

[22] Filed: May 14, 1975

[51] Int. Cl.[2] ..... G04B 19/24; G04C 3/00; G04B 27/00

[52] U.S. Cl. ..... 58/4 A; 58/23 R; 58/50 R; 58/58; 58/85.5

[58] Field of Search ..... 58/4 A, 50 R, 58, 85.5, 58/.23 R

[56] References Cited

U.S. PATENT DOCUMENTS

| | | | |
|---|---|---|---|
| 3,765,163 | 10/1973 | Levine | 58/50 R |
| 3,810,356 | 5/1974 | Fujita | 58/85.5 |
| 3,866,406 | 2/1975 | Roberts | 58/85.5 |
| 3,939,640 | 2/1976 | Kahn | 58/23 R |
| 3,943,696 | 3/1976 | Portmann et al. | 58/23 R |

*Primary Examiner*—Edith S. Jackmon
*Attorney, Agent, or Firm*—Knobbe, Martens, Olson, Hubbard & Bear

[57] ABSTRACT

A solid state watch in which the computed time and date values are selectively displayed by actuating a single switch. This and a setting mode switch are the only switches required for performing the multiple functions of setting individually the hours, minutes, seconds, day and month, and of selecting the time and calendar date information to be displayed.

5 Claims, 5 Drawing Figures

| T | $\overline{R}$ | $Q_{R+1}$ |
|---|---|---|
| ↗ | 1 | $\overline{Q_n}$ |
| ↘ | 1 | $Q_n$ |
| 1 | 0 | 0 |
| 0 | 0 | UNDEFINED |

FIG. 5

DISPLAY CONTROL

| FF 75 Q | FF 63 Q | FF 91 Q | SWITCH 11 | DISPLAY STATE |
|---|---|---|---|---|
| 0 | 0 | 0 | OPEN | BLANK |
| 1 | 0 | 0 | CLOSED OR OPEN | HOURS: MINUTES |
| 1 | 0 | 1 | CLOSED | SECONDS |
| 0 | 1 | 0 | CLOSED OR OPEN | MONTH DATE |
| 0 | 1 | 1 | CLOSED | MONTH DATE |

SET CONTROL

| FF 125 Q | FF 126 Q | FF 127 Q | SET MODE |
|---|---|---|---|
| 0 | 0 | 0 | NORMAL MODE |
| 1 | 0 | 0 | SET HOURS |
| 0 | 1 | 0 | SET MINUTES |
| 1 | 1 | 0 | SET MONTH |
| 0 | 0 | 1 | SET DATE |
| 1 | 0 | 1 | RESET (MINUTES NOT ADVANCED) |
| 1 | 0 | 1 | HOLD (MINUTES ADVANCED) |

SOLID STATE WATCH WITH SINGLE TIME AND DATE SELECTOR BUTTON

BACKGROUND OF THE INVENTION

This invention relates to a solid state watch in which a frequency standard is divided down to provide a highly accurate one Hz signal. This signal drives a time and calendar computer in which a series of registers store binary encoded values corresponding to seconds, minutes, hours, days and months. The binary encoded information provided by the time and calendar computer is decoded and displayed on a visual read out. The current state of the art enables essentially the entire electronic circuitry of the watch to be constructed as a single large scale integrated circuit. In order to reduce battery consumption to a minimum, this integrated circuitry is advantageously provided by complementary MOS circuitry or other circuit types having inherently low power consumption.

The type of readout display which has achieved overwhelming popularity in the consumer market is formed from a plurality of light emitting diodes arranged to display Arabic numerals. This type of readout, however, requires a fair amount of electrical power such that it is impractical to continuously energize the optical display. Accordingly, it has been the contemporary practice to provide a series of push button switches for each of the time display and time setting sequences. Thus, all prior art solid state watches capable of displaying both the time and calendar data have at least three buttons for selecting the time and the date, and presetting the time and the date registers. Such prior art watches often require two buttons to be simultaneously depressed to provide the time setting sequence. Such multiple button watches obviously induce a complicating factor in reading and setting watches since the user must remember which button provides which function. Moreover, the multiple buttons add an additional expense to the manufacturing cost of the watch and tend to decrease the reliability of the watch. Thus, the switches commonly employed are either magnetic reed switches, which are relatively expensive and require the user to have a permanent magnet to set the watch, or push pins on the side of the watch case which engage a contact within the watch case. These latter switches have the problem of waterproofing openings in the watch case.

SUMMARY OF THE INVENTION

In its preferred embodiment, the present invention provides a solid state watch in which a single switch selects both the time and calendar date information and a second switch in conjunction with the time and calendar date selector switch provides for the time setting sequence. The time and calendar date selector switch is connected to display control logic advantageously formed as part of the same large scale integrated circuit forming the time and calendar computer. This display control logic recognizes whether the time and date selector switch has been actuated one time or two times. Thus, in the preferred embodiment, a single actuation of the switch causes the hours and minutes to be displayed for a predetermined time period, e.g. 2 seconds after which, if the switch has been released, the display is extinguished. If on the other hand the time and calendar date select switch is actuated twice in succession and then released, the month and day are displayed for the timed interval. If the switch is not released during the hours and minutes display time, the hours and minutes display is interrupted after the timed interval and seconds are displayed until release of the switch button.

A single set mode switch is operatively connected to set control logic which is also advantageously formed as part of the same large scale integrated circuit forming the time and calendar computer. This set mode logic recognizes sequential actuations of the set mode switch such that, in the preferred embodiment, the initial actuation of this set mode switch places the watch in the hours set mode; the second actuation enables the minutes set mode; the third actuation enables the month set mode; and the fourth actuation enables the day set state. During each of these modes, the registers of the time and calendar computer can be advanced under control of the time and calendar date select button to the appropriate value.

BRIEF DESCRIPTION OF THE DRAWINGS

FIG. 5 is a table summarizing the states of certain of the flip flop stages incorporated in the display control and set control stages of FIG. 4.

OVERALL DESCRIPTION OF THE SOLID STATE WATCH

Figures 1, 3:
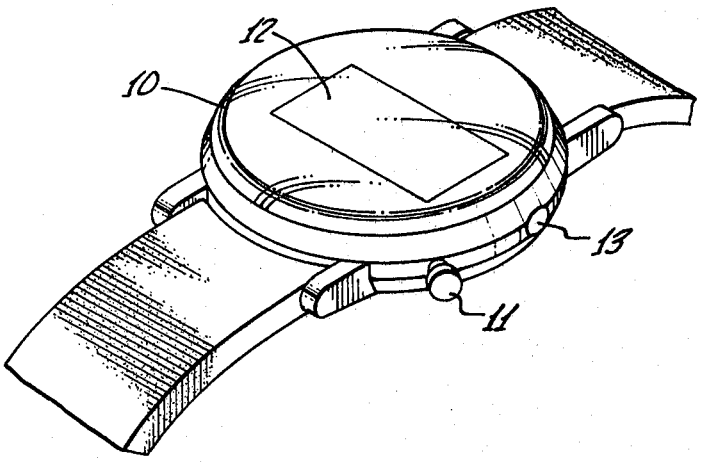
FIG. 1 is a perspective view of a typical solid state watch constructed in accordance with the present invention in which a single time and calendar date select switch is provided and a single set mode switch is provided.
FIG. 3 is a truth table showing the operation of the flip flop incorporated in FIG. 4.

Referring to FIG. 1, the solid state watch 10 of this invention is distinguished from contemporary solid state watches by having a single time and calendar date selector push button switch 11 extending outwardly from the side of the watch case. In accordance with current practice, the light emitting diodes forming the visual digital display are placed underneath a colored filter 12. This display is blank at all times except when energized by switch 11.

In the preferred embodiment described herein, a single actuation of the switch 11 provides a display of the hours and minutes in Arabic numerals underneath the filter 12. This display will be extinguished after a predetermined timed interval. If, instead, the single switch 11 is depressed twice in succession, the month and day will be displayed in Arabic numerals, i.e. 10:2 indicating October 10. If the switch button is released after the second actuation, the calendar information will be extinguished after this same timed interval. If instead the button is not released after the second depression, the date information will be retained until the button is released. Seconds are displayed whenever the switch 11 is held down instead of being released after selection of the hours and minutes. The seconds will then be automatically displayed after the hours and minutes have been displayed for the timed interval.

The time setting sequence is provided by set mode push button switch 13. Since this switch is used infrequently, it is preferably formed flush with the side of the watch case and actuated by a pointed tool. Switch 13 provides a sequence of set modes as follows: The first actuation of switch 13 enables setting of hours; the second actuation enables the setting of minutes; the third actuation enables the setting of months; and the fourth actuation enables the setting of days. In each of these set modes, the user changes the value stored in the time and calendar registers by depressing the time and date selector button 11 while observing the value stored as displayed on the readout beneath filter 12.

Figure 2:
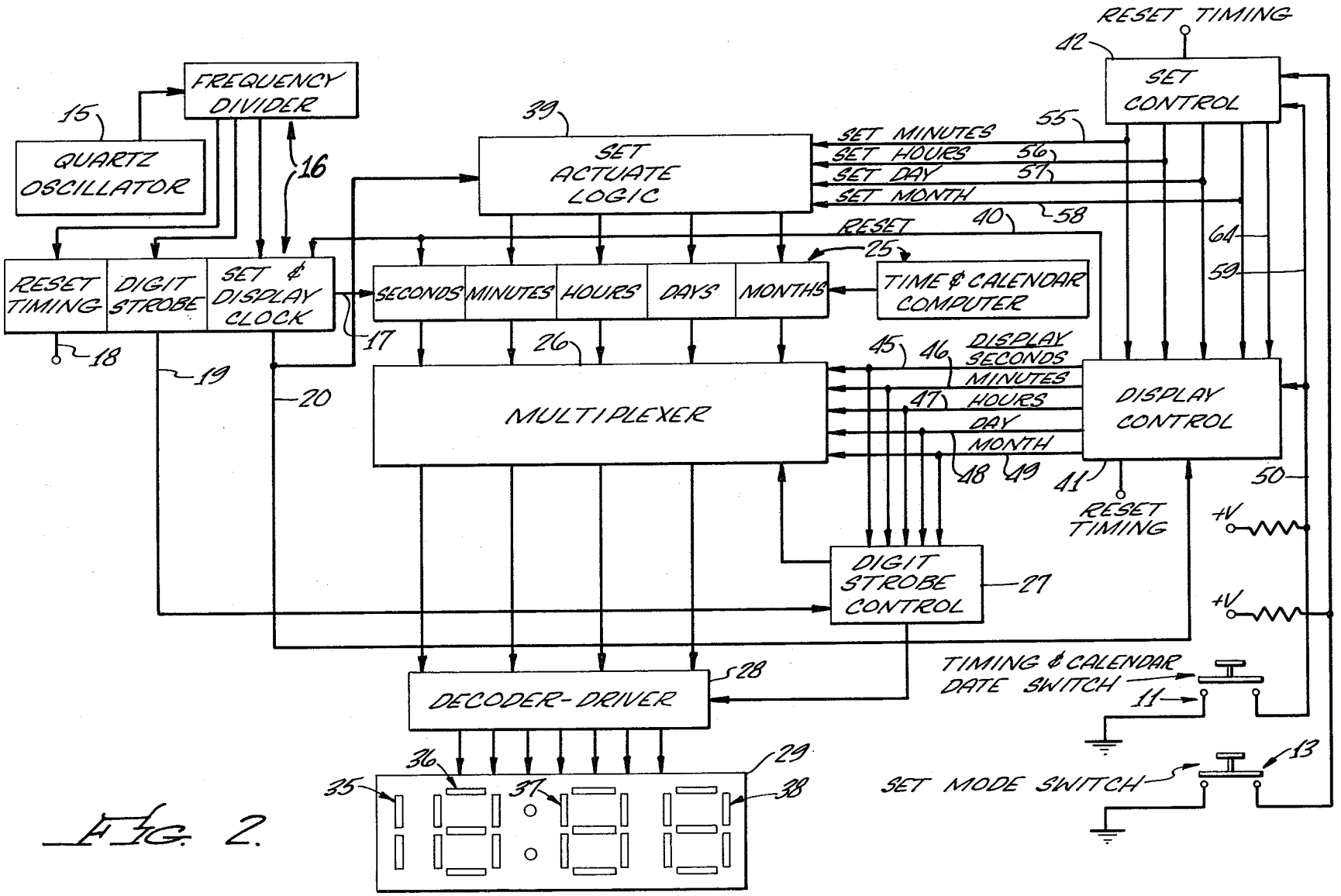
FIG. 2 is an overall block diagram of the solid state watch incorporating the single time and calendar date selector switch and single set mode switch.

Referring now to FIG. 2, a frequency standard in the form of a quartz oscillator 15 drives a frequency divider 16 which produces a 1 Hz output on lead 17. In addition, the frequency divider provides a reset timing signal on lead 18, a digit strobe signal on lead 19, and a set and display clock signal on lead 20. Typical frequencies for these signals are 512 Hz for the reset timing signal, 64 Hz for the digit strobe signal and 2 Hz for the set and display clock.

The 1 Hz signal on output lead 17 is coupled to the time and calendar computer 25 which includes a series of frequency dividers and registers for storing binary encoded values corresponding to seconds, minutes, hours, days and months. It will be understood that the time and calendar computer is continuously in operation, whereas the time and date information computed therein is selectively displayed when the user actuates the single time and calendar date select switch 11.

The readout display function is provided by the circuit blocks entitled multiplexer 26, digit strobe control 27 and decode driver 28. The visual display is advantageously provided by a multi-segment solid state digital readout 29 adapted to display the time and date information in Arabic numerals. The multiplexer 26 enables selected information from time and calendar computer 25 register to be displayed on a four digit readout 29. For example, as noted above, a single actuation of the time and date selector switch 11 causes the minutes and hours information in the computer 25 to be switched through the multiplexer 26 to the decode-driver stage 28. This latter stage converts the binary encoded information to the requisite seven segment code for appropriately energizing the digital display 29. In order to conserve on energy consumption during the display, the four digits 35, 36, 37, and 38 of the display are sequentially energized at a sufficiently high repetition rate that the viewer sees a continuously lit readout. This function is provided by the digit strobe control 27 which responds to the 64 Hz digit strobe output generated by the frequency divider 16. The digit strobe control divides each 1/64 second period into four equal time periods in which the four digits 35–38 of the display are sequentially strobed. For example, assume that the time and calendar date select switch 11 has been actuated once thereby initiating the display of the hours and minutes. Assuming that the time is 12:05, the first digit 35 of the display 29 will be strobed during the first time period to provide a readout of the numeral 1; the second digit 36 of the display will be strobed during the second time period to provide a readout of the Arabic numeral 2; the third digit 37 of the display will be strobed during the third time period to provide a readout of the Arabic numeral 0; and the fourth digit of the readout will be strobed during the fourth time period to provide a readout of the Arabic numeral 5.

Each of the minutes, hours, days and months registers of the time and calendar computer 25 may be individually preset to a predetermined value by the set actuate logic 39. As shown, this logic is responsive to the 2 Hz set and display clock signal on lead 20. When this set actuate logic is enabled, a selected register in the computer 25 is individually advanced at the 2 Hz rate until it stores the requisite value. In addition, a reset signal on lead 40 resets to zero the final stages of the frequency divider 16 and the seconds register of computer 25, thereby permitting precise setting of the watch seconds register.

Figure 4:
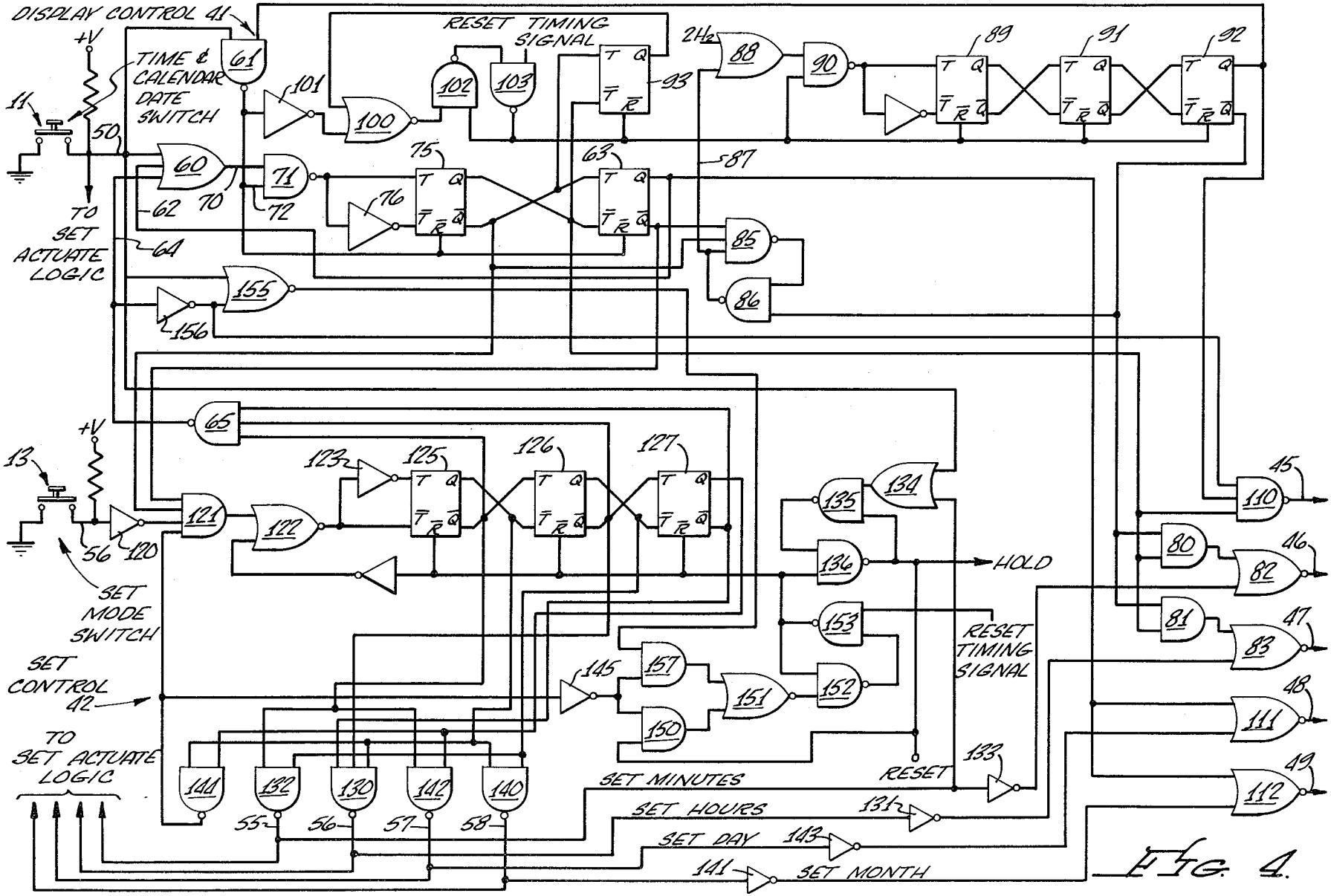
FIG. 4 is a detailed schematic of the display control and set control portions of FIG. 2.

The configuration of those portions of the solid state watch shown in FIG. 2 which have so far been described are well known in the art and described in the literature. The additional portions of this diagram denoted as the display control 40 and set control 41 provide for the novel single switch time and calendar date select and single switch set mode features of this invention. The function of these units will be generally described with reference to FIG. 2 and the comprehensive circuit details thereof are shown in FIG. 4 and described hereinafter.

The display control 41 is responsively connected to the time and calendar date select switch 11 and operatively coupled to the multiplexer 26 via leads 45 and 49. As shown, when the switch is open, a positive voltage is supplied to the input lead 50, whereas, when the switch is closed, this lead is grounded, and a negative going signal is applied to the input lead 50 of the display control 41. In the following description, a negative going signal is designated as a binary "0" signal and a positive going signal is designated as a binary "1" signal. Thus, when the time and date switch 11 is closed, a binary "0" signal is applied to the input of display control 40. The display control then supplies enable signals to the display minutes lead 46 and the display hours lead 47 connected to the multiplexer 26. As a result, the value of the hours and minutes stored in the time and calendar computer 25 are caused to be displayed on the digital readout 29. After a timed interval generated by the display control 40, the enable signals on the leads 46, 47 are removed and the readout display is extinguished. If instead the time and date selector switch 11 remains actuated, i.e. lead 50 is held at the binary "0" level, the display control terminates the enable signals on the display minutes and hours leads 46 and 47 at the end of the timed interval and the display seconds lead 45 is then enabled until the switch 11 is released. Multiplexer 26 responds to the signal on lead 45 to cause the value stored in the seconds register of the time and calendar computer 25 to be displayed on the digital readout 29.

Calendar information is caused to be displayed by the single time and calendar date select switch 11 in the following manner. If the user actuates this switch twice in succession, the display control 41 enables the display day lead 48 and display month lead 49. The multiplexer 26 then connects the days and months registers of the time and calendar computer 25 to the digital display 29. Unless the user continues to hold down the push button switch 11, the enabling signals on the display day and display month leads 48 and 49 will be removed at the end of the predetermined timed interval, thereby extinguishing the visual display. If the user maintains the time and date selector switch 11 in its closed position, the days and months will continue to be displayed until the switch 11 is opened.

The setting sequence is controlled by the single set mode switch 13 coupled to both the display control 41 and set control 42. Set control 42 is operatively connected to the set actuate logic 39 and display control 41 by leads 55–58. As shown, when set mode switch is actuated, a binary "0" signal is applied to lead 56 connected to the set control 42, an inhibit signal on lead 64 inhibits the normal operation of the display control circuitry 41 during the setting sequence. Each time the set mode switch 13 is actuated, the set control 42 sequences to a different set mode in which an enabling signal is applied to the set actuate logic 39 via one of the leads 55–58. During each set mode, the user can change the value stored in one of the registers of time and calendar computer 25 to any predetermined value by actuating the time and date select switch 11 and observing the value stored in the time and calendar computer register as it is displayed on the digital display 29. For example, the initial actuation of set mode switch 13 causes the set control to initiate the hours set mode. The binary "0" signal applied to the display control 41 inhibits normal operation of this stage during the setting sequence. As a result, the set hours lead 56 is enabled causing the display control to energize the display hours lead 47 and the set actuate logic 39 to be activated in the set hours mode. The user then observes the value of the hours stored in the time and calendar computer 25 as displayed on the readout 29. If the value is incorrect, the user actuates the time and date select switch 11 which, as shown, is connected to the set arcuate logic 39 and causes the computer register to be advanced at a 2 Hz rate. When the appropriate number is observed on the digital readout 29, the user releases the time and date select switch 11 and this value is retained in the hours register of the time and date computer. A succeeding actuation of the set mode switch 13 causes the set control to be placed in the minutes set mode. As a result, the set minutes lead 55 is enabled causing the display control to energize the display minutes lead 46 and the set actuate logic to be activated in the set minutes mode. The value stored in the minutes register of the time and calendar computer 25 is then visually displayed and may be advanced at a 2 Hz rate by closing the time and date selector switch 11 until the appropriate value is shown in the display. If the minutes are advanced, the display control produces the reset signal on lead 40 which, as described above, resets to zero the seconds register of the computer 25 and also the final stages of the frequency divider 16. During the remainder of the set sequence, the normal operation of the divider is inhibited if the minutes are advanced. Also, as described below, an additional "hold" mode is added to allow precise setting of the watch if minutes are advanced. If the minutes are not advanced, normal operation of the divider 16 continues through the set sequence, since it is assumed that the setting procedure will be completed before the hours, days, or months registers will be advanced by the 1 Hz signal on lead 17. The months set mode and days set mode are respectively initiated by the third and fourth sequential closures of the set mode switch 13. In each of these modes, the months and days registers of computer 25 may be advanced by closing the switch 11.

The setting sequence is completed as follows: As stated previously, if the minutes register of computer 25 was advanced during the minutes set mode, a "hold" mode is entered when set mode switch 13 is closed the fifth time. The seconds register of computer 25 continues to remain at zero. The watch is retained in this "hold" mode until the precise instant of time preset in the minutes register of computer 25. Normal watch operation commences by closing the time and date select switch 11. If, on the other hand, the watch did not enter the "hold" mode (i.e. the minutes were not advanced during the minutes set mode) the fifth closure of set mode switch 13 completes the setting sequence and the watch is placed in its normal operating mode.

DETAILED DESCRIPTION OF THE DISPLAY CONTROL CIRCUITRY

Referring now to FIG. 4, a time or time and calendar select sequence is initiated by closing the time and calendar date switch 11. Actuating this switch changes the signal on lead 50 to a binary "0". As a result, the output 70 of OR gate 60 changes from a binary "1" to a binary "0" signal (OR gate 60 also has an input 62 connected to the "Q" output of flip flop 63 and an input 64 connected to the output of inhibit NAND gate 65. As will be apparent from the following description, each of these inputs remain at binary "0" level upon initiation of a time and calendar date select sequence). The output of NAND gate 71 then changes from a binary "0" to a binary "1" (since, for reasons described below, its other input 72 remains at a binary "1" level both before and after closure of the switch 11). Referring to FIG. 3, it will be seen that the resultant voltage rise at the T input of flip flop 75 and a voltage drop at its $\overline{T}$ input (by virtue of the inverter stage 76) triggers flip flop 75 from its original binary "0" state to its binary "1" state.

Flip flop 75 when triggered both enables display of minutes and hours and also initiates a timed readout period. The minutes and hours display is provided by the change to binary "1" on the Q output of flip flop 75 which enables AND gates 80 and 81 and NOR gates 82, 83 respectively coupled to the display minutes lead 46 and the display hours lead 47. As shown in FIG. 2 and described above, when these leads are enabled the multiplexer 26 causes the hours and minutes values stored in the time and date computer 25 to be displayed on the digital readout 29. The timed display interval is initiated by the change on the $\overline{Q}$ output of flip flop 75 from a binary "1" to a binary "0" signal level which is supplied as an input to NOR gate 85. NOR gate 85 and NOR gate 86 are cross coupled to normally apply a binary "1" signal to input lead 87 of OR gate 88 and thereby inhibit passage of the 2 Hz set and display clock to the T input of flip flop 89. However, when the signal on lead 87 changes to a binary "0", each time the 2 Hz goes to binary "0", the output of NAND gate 90 is caused to go to a binary "1" and flip flop 90 is triggered. Flip flops 89, 91 and 92 function as a count down counter responsive to the 2 Hz set and display clock. As a result, flip flop 92 triggers to its binary "1" state between 1.5 and 2 seconds after switch 11 is closed and concludes the timed display interval.

The operating states of flip flops 75, 63 and 91 during the display mode sequence are tabulated in FIG. 5. The complete display sequence will now be described.

Display Control Operation — Time and Calendar Switch Open at End of Timed Interval During this timed display interval, the watch displays the hours and minutes on digital readout 29. If during this interval the user releases the time and date select switch 11 such that the switch remains open at the end of this timed interval, the hours and minutes display is turned off upon triggering of flip flop 92 to its binary 1 state since the binary "0" signal on its $\overline{Q}$ output disables AND gates 80 and 81. The binary "1" signal on the Q output of counter flip flop 92 also then results in reset of flip flop 75 in the following manner. Up to the end of the timed interval, the output 72 of NAND gate 61 is maintained at a binary "1" level by the binary "0" level supplied at the Q output of flip flop 92. When flip flop 12 is triggered, the simultaneous binary "1" inputs on NAND gate 61 produce a binary "0" signal at its output 72 and this signal is connected to the $\overline{R}$ inputs of both flip flops 75 and 63. As shown in the truth table of FIG. 3, the flip flop 75 will then be reset to its binary "0" state.

Reset of flip flop 75 also enables the reset of the counter flip flops 89, 91 and 92 in the following manner. When flip flop 75 is reset, the binary "1" signal on its $\overline{Q}$ output triggers flip flop 93 to its binary "1" state. Both inputs of NAND gate 100 are then binary "1"s (inverter state 101 inverting the output of NAND gate 61) and the resultant binary "0" signal at its output changes the signal at the output of NAND gate 102 to a binary "1". Thus, when the 512 Hz reset timing signal changes to a binary "1", the output of NAND gate 103 changes to a binary "0", causing flip flops 93, 89, 91 and 92 to be reset. Gates 102 and 103 provide a latch circuit insuring a minimum reset pulse width and eliminating a possible race condition.

Display Control Operation — Time and Calendar Switch Closed at End of Timed Interval If on the other hand, the user does not release the time and calendar date select switch 11 during the time interval, flip flop 75 remains at its binary "1" state and NAND gate 110 coupled to the display seconds lead 45 is enabled when flip flop 92 is triggered to its binary "1" state. In addition, as heretofore noted, the display minutes and display hours leads 46 and 47 are disabled when flip flop 92 changes state. As a result, the multiplexer 26 causes the seconds values computed in the computer 25 to be displayed on the digital readout 29. Seconds are then shown on the visual display until the time and date select switch 11 is opened, causing flip flop 75 to be reset to its binary "0" set and disabling of NAND gate 110.

Display Control Operation — Time and Calendar Switch Actuated Twice During Timed Interval As noted above, a distinguishing feature of the present invention is that the single time and date selector switch 11 controls both selection of time and calendar date. Thus, when the user desires to have the calendar date displayed, the switch 11 is actuated twice in succession. As a result, a second positive voltage swing is applied on the T input of flip flop 75 changing this flip flop to its binary "0" state. The resultant rise in potential on its $\overline{Q}$ output causes coupled flip flop 63 to change to its binary "1" state, thus enabling the day and month display NAND gates 111, 112. The display day and display month leads 48, 49 coupled to multiplexer 26 are enabled by the binary "1" state of flip flop 63 and day and month values stored in the register of the computer 25 are displayed on digital readout 29. Flip flop 63 in the binary "1" state also provides an inhibiting binary "1" signal to input 62 of OR gate 60. As a result, the output 70 of this gate is maintained at a binary "1" lead so long as flip flop 63 is in its binary "1" state and additional actuations of the time and date switch 11 have no effect on either flip flop 75 or 63 until the display cycle has been completed.

When the flip flop 75 was triggered back to its binary "0" state, a triggering signal was also then applied to the T input of flip flop 93, causing this flip flop to change to its binary "1" state. The output of NAND gate 100 thereupon changes to binary "0" and the output of NAND gate 102 to binary "1" such that when the 512 Hz timing signal goes to binary "1", the resulting binary "0" signal at the output of NAND gate 103 resets flip flop 93 along with counter stage flip flops 89, 91, 92. When the reset timing signal goes to binary "0", a binary "1" is supplied the $\overline{R}$ inputs of flip flops 89, 91 and 92 and the timed interval counter starts to again count down under control of the 2 Hz set and display clock. The month and date display is therefore enabled until flip flop 92 is triggered at the conclusion of the timed interval (at which time flip flop 63 is reset if the switch 11 is open). If the user has maintained switch 11 closed, the time and date information is not extinguished until the user opens switch 11, whereupon both inputs of NAND gate 61 are binary "1"s to provide the reset binary "0" signal to the $\overline{R}$ input of flip flop 63. The change of flip flop 63 to its binary "0" state removes the inhibit signal or OR gate 60 and the watch is in its normal or blank display mode.

It will thus be seen that flip flops 75 and 63 provide a means responsive to the number of times that the time and calendar date switch 11 is actuated for enabling the multiplexer 26 to supply either time or date information to the digital display 29.

DETAILED DESCRIPTION OF THE SET CONTROL CIRCUITRY

The setting sequence provided by set control 42 is initiated by closing the set mode switch 13 thereby grounding the input 56 to inverter stage 120 and supplying a binary "1" signal at its output to AND gate 121. AND gate 121 insures that the setting sequence is not initiated unless the display is blank since this gate will be inhibited by one or the other of the Q outputs of flip flop 75, 63 if one of these flip flops is in its binary "1" state. The resultant binary "0" signal at the output of NOR gate 122 when AND gate 121 is enabled is inverted by inverter 123 to provide a rising voltage on the T input of flip flop 125. This flip flop is thereupon triggered to its binary "1" state. Flip flops 125, 126 and 127 provide a means for recognizing sequential actuations of the set mode switch 13 for placing the watch in a series of set modes. During a set mode (indicated by any one or two of the flip flops 125, 126 and 127 being triggered to their binary "1" states), a binary "1" inhibit signal appears on the output 64 of NAND gate 65 by virtue of its inputs being connected to respective Q outputs of these flip flops. As a result, the normal operation of the display control 41 is inhibited during the set mode sequence. The operating states of the set control flip flops 125, 126 and 127 during the set mode sequence are tabulated in FIG. 5. The complete set mode sequence will now be described.

Set Mode Operation — Set Hours

As noted in the preceding paragraph, the initial closure of the set mode switch 13 causes flip flop 125 to change to its binary "1" state. NAND gate 130 is then enabled and an enabling signal applied to the set hours input 56 of set actuate logic 39. The binary "0" signal on lead 56 is also inverted in stage 131 and supplied to NOR gate 83 for providing an enabling signal on the display hours lead 47. The contents of the hours register of computer 25 are then caused to be visually displayed on digital readout 29 (FIG. 2). As noted above, in accordance with circuitry well known in the art, and accordingly not shown herein, the user may, by actuating the time and calendar switch 11, cause the hours register within computer 25 to be advanced at the 2 Hz rate of the set and display clock.

Set Mode Operation — Set Minutes

The second closure of switch 13 triggers flip flop 125 back to its binary "0" state. The resultant voltage rise on its $\overline{Q}$ output triggers flip flop 126 to its binary "1" state. NAND gate 132 is then enabled and an enabling signal applied to the set minutes input 55 of set actuate logic 39. The binary "0" signal on lead 55 is also inverted in state 133 and supplied to NOR gate 82 for providing an enabling signal on the display minutes lead 46. The contents of the minutes register of computer 25 are then caused to be visually displayed on digital readout 29 (FIG. 2). If the switch 11 is then closed to advance the minutes register of computer 25, a binary "0" signal is supplied to one input of the NOR gate 134 via lead 50. Since the other input of NOR gate 134 is connected to the set minutes lead 55, both inputs are zero and cross coupled NAND gates 135, 136 latch in the opposite state wherein the output of NAND gate 135 is a binary "1" and the output of NAND gate 136 is a binary "0". The signal at the output of NAND gate 136 controls the end of the set mode sequence, either adding a "hold" mode if a binary "0" (indicative that the minutes register was advanced) or eliminating the "hold" mode if a binary "1".

Set Mode Operation — Set Month

The third closure of the set mode switch 13 triggers flip flop 125 to its binary "1" state. NAND gate 140 is then enabled and an enabling signal applied to the set month input 58 of the set actuate logic 39. The binary "0" signal on lead 58 is inverted in stage 141 and supplied to NOR gate 112 for providing an enabling signal on the display month lead 49. The contents of the month register of computer 25 are then visually displayed on digital readout 29 (FIG. 2).

Set Mode Operation — Set Day

The fourth closure of the set mode switch 13 triggers flip flops 125 and 126 to their binary "0" state and flip flop 127 to its binary "1" state. NAND gate 142 is then enabled and an enabling signal applied to the set day input 57 of the set actuate logic. The binary "0" signal on lead 57 is inverted in stage 143 and supplied to NOR gate 111 for providing an enabling signal on the display day lead 48. The contents of the day register of computer 25 are then visually displayed on digital readout 29 (FIG. 2).

Set Mode Operation — Completion

The fifth closure of set mode switch 13 triggers flip flop 125 to its binary "1" state (flip flops 126 and 127 remain in their respective binary "0" and binary "1" states). NAND gate 144 is then enabled and a binary "0" signal appears at the input of inverting stage 145. If the output of NAND gate 136 is a binary "1", i.e. the minutes register was not advanced during the set minutes mode, simultaneous binary "1" signals are applied to the respective inputs of AND gate 150. The resultant binary "0" signal at the output of NOR gate 151 and binary "1" signals at the output of NAND gate 152 enable NAND gate 153 such that when the 512 Hz reset timing signal goes to binary "1", gates 152, 153 latch and apply a binary "0" signal to the respective $\overline{R}$ inputs of flip flops 125, 126 and 127 to reset these stages to their binary "0" state and thus conclude the set mode.

On the other hand, if the output of NAND gate 136 is a binary "0", i.e. the minutes register was advanced during the set minutes mode, the watch is placed in the "hold" mode as described above. The setting sequence is then not completed until the time and calendar switch 11 is actuated, at which time the binary "0" signal on lead 50 causes the output of NOR gate 155 to change to binary "1" (the inverter 156 maintains the other input of NOR gate 155 at binary "0"). Simultaneous binary "1" inputs enable AND gate 157, resulting in a binary "1" signal at the output of NAND gate 152. Gates 152 and 153 are then latched when the reset timing signal goes to binary "1" and flip flops 125, 126 and 127 reset to terminate both the "hold" mode and the set mode.

What is claimed is:

1. A solid state watch comprising:

an oscillator whose output frequency is stable over an appreciable length of time;

a frequency divider responsively coupled to said oscillator for providing a one Hz output signal;

a time and calendar computer for computing and registering the values of seconds, minutes, hours, day and month;

a visual display means;

multiplexer means coupled to said time and calendar computer for supplying selected time and calendar date values to said visual display means;

display control means responsive to the number of times that said switch is actuated for enabling said multiplexer means to supply either time or calendar date information to said visual display means, said display control means being enabled in mutually exclusive time and date display modes upon sequential actuation of said single switch; and means for automatically resetting after a predetermined time period said display control means to its original state prior to actuation of said single switch so that said date display mode is not entered unless said switch is twice actuated within said predetermined time period.

2. A solid state watch comprising:

a frequency standard;

time and calendar computer means responsive to said frequency standard for registering the values of time and calendar date;

means for displaying values of time and calendar date;

a single switch for selecting on sequential actuations both the time and calendar date information to be displayed on said display means;

display control means coupled to said switch and operatively coupled to said display means for recognizing sequential actuation of said switch and selectively enabling time and calendar date values registered in said computer to be displayed, said display control means being enabled in mutually exclusive time and date display modes upon sequential actuation of said single switch;

means for automatically resetting after a predetermined time period said display control means to its original state prior to actuation of said single switch; and a timed interval counter included in said display control means, said display control enabling the display of hours and minutes followed by the display of seconds upon actuation of said single switch and retention thereof in an actuated state beyond said timed interval.

3. The solid state watch of claim 2 wherein:

said display control means terminates the display of calendar date upon expiration of said timed interval.

4. A solid state watch comprising:

means for displaying digital values of time and calendar date;

a quartz frequency standard;

a single time and calendar select switch for for both the time and calendar date information to be displayed on said display means;

a single set mode switch for selecting plural setting modes;

a single large scale integrated circuit including, a frequency divider for dividing down the frequency output of said quartz frequency standard to one hz, a time and calendar computer for computing and registering the values of seconds, minutes, hours, day and month, multiplexer means coupled to said time and calendar computer for supplying selected time and calendar date values to said display means, display control means responsive to the number of times that said time and calendar select switch is actuated for enabling said multiplexer means to supply either time or calendar date information to said display means, display control means being enabled in mutually exclusive time and date display modes upon sequential actuation of said single switch, means for automatically resetting after a predetermined time period said display control means to its original state prior to actuation of said single switch so that said date display mode is not entered unless said switch is twice actuated within said predetermined time period; and set control means responsive to sequential actuation of said set mode switch for selectively presetting the seconds, minutes, hours, day and month registered in said time and calendar computer.

5. A solid state watch comprising:

an oscillator whose output frequency is stable over an appreciable length of time;

a frequency divider responsively coupled to said oscillator for providing a one Hz output signal;

a time and calendar computer for computing and registering the values of seconds, minutes, hours, day, and month;

a visual display means;

multiplexer means coupled to said time and calendar computer for supplying selected time and calendar date values to said visual display means;

display control means responsive to the number of times that said switch is actuated for enabling said multiplexer means to supply either time or calendar date information to said visual display means, said display control means being enabled in mutually exclusive time and date display modes upon sequential actuation of said single switch; and means for automatically resetting after a predetermined time period said display control means to its original state prior to actuation of said single switch so that said date display mode is not entered unless said switch is twice actuated within said predetermined time period;

a single switch for selecting plural setting modes; and set control means coupled to said set mode switch and operatively coupled to said computer for recognizing sequential actuations of said set mode switch for selectively presetting the time and calendar date values registered in said computer, said set control means providing hours, minutes, month and day set modes according to the number of actuations of said set mode switch, said set control means being responsive to presetting of the minutes value registered in said computer and providing a hold mode after the hours, minutes, month and day set modes until said time and calendar date switch is actuated.

* * * * *